United States Patent [19]

Watts

[11] 4,395,851

[45] Aug. 2, 1983

[54] CENTRIFUGAL ABRASIVE BLASTING MACHINE

[76] Inventor: W. David Watts, P.O. Box 48474, Atlanta, Ga. 30362

[21] Appl. No.: 231,255

[22] Filed: Feb. 3, 1981

[51] Int. Cl.[3] ..... B24C 5/06

[52] U.S. Cl. ..... 51/434; 51/435

[58] Field of Search ..... 51/432, 433, 434, 435; 241/275; 308/165; 416/214, 220

[56] References Cited

U.S. PATENT DOCUMENTS

| | | | |
|---|---|---|---|
| 2,869,289 | 1/1959 | Gossard | 51/435 |
| 3,429,351 | 2/1969 | Szalanczy | 416/220 |
| 3,683,556 | 8/1972 | Leliaert | 51/434 |
| 3,936,222 | 2/1976 | Asplund et al. | 416/220 R |
| 4,069,025 | 1/1978 | Macmillan | 51/435 |
| 4,164,104 | 8/1979 | Carpenter et al. | 51/434 |
| 4,333,278 | 6/1982 | Schulte et al. | 51/435 |

FOREIGN PATENT DOCUMENTS

| | | | |
|---|---|---|---|
| 2323908 | 4/1977 | France | 416/220 |

*Primary Examiner*—James G. Smith
*Assistant Examiner*—Willmon Fridie, Jr.
*Attorney, Agent, or Firm*—William Nitkin

[57] ABSTRACT

An improved abrasive particle blast wheel combining high particle feed rate and long parts wear characteristics, comprising a series of reversible blades mounted within a runner head. An impellor is adapted to rotate in the hub of the wheel within a control cage with each vane of the impellor aligned dead center with the inner end of each blade respectively. The control cage has a large rectangular particle escape opening. An enlarged feed spout conducts the abrasive particles into the impellor assembly and the wheel rotates at a slower than normal speed but maintains high tip velocity due to the larger than normal diameter of the blades. The direction of rotation of the wheel of this invention is reversible without any structural modifications having been made. An improved wear plate structure is also provided wherein some of the wear plate parts are interchangeable with one another.

2 Claims, 5 Drawing Figures

CENTRIFUGAL ABRASIVE BLASTING MACHINE

BACKGROUND OF THE INVENTION

1. Field of the Invention

This invention relates to the art of airless blast cleaning equipment and more particularly to apparatus of the type which include a rotating wheel with blades that forcefully propel a stream of abrasive particles for impingement against a workpiece.

2. History of the Prior Art

Centrifugal blasting machines are well-known in the prior art. Such machines typically have a motor-driven rotating throwing wheel with a plurality of blade members disposed along radii of the wheel. The wheel is usually constructed of two outer discs, each of which has opposing radial grooves which receive the throwing blades and include means for locking such blades in position to prevent their dislodgement during operation. These blades are subject to substantial wear and must be replaced periodically. The abrasive particles usually enter the wheel through a supply conduit running into the wheel's hub. An impellor is mounted in this central hub opening adapted to rotate with the wheel and to direct the abrasive particles through an opening in a surrounding control cage onto the face of each blade in turn. Around portions of the wheel may be replaceable wear plates.

Examples of such blasting machines are disclosed in the following U.S. patents:

U.S. Pat. No. 2,132,311 to Minich
U.S. Pat. No. 3,319,383 to A. E. Bowling
U.S. Pat. No. 3,566,644 to Moore
U.S. Pat. No. 3,867,791 to Goff

SUMMARY

It is an object of this invention to provide an abrasive blast wheel which has increased blade life due to several reasons discussed below, but including a reversibility feature of the blades so that the blades may be worn on two sides before they are replaced.

It is a further object of this invention to simplify the wear plate construction while increasing the durability thereof. Several of the wear plates have been made interchangeable so that fewer replacement parts need be stocked by the user.

It is a still further object of this invention to provide a redesigned feed spout assembly to enable the machine to receive larger amounts of abrasive particles than is standard in prior art machines.

The abrasive blast wheel of this invention is adapted to operate in either a clockwise or counterclockwise rotation without the need of any structural changes. The wheel of this invention is further adapted to be operable at a variety of horsepowers in a range of 5 horsepower–65 horsepower without making any structural changes.

It is yet still a further object of this invention to provide a wheel that will throw in excess of 2,000 lbs of abrasive particles per horsepower per hour.

It is an additional object of this invention to provide a wheel which operates at a lower rpm than is standard in the prior art, resulting in a tripling of the blade life due to the lower frictional drag across the blade of the abrasive particles. The lower speed of the blade is also one of the factors which allows the increased flow of abrasive particles. A high tip velocity is still maintained due to the wheel's larger diameter.

BRIEF DESCRIPTION OF THE PREFERRED EMBODIMENT(S)

Figure 1:
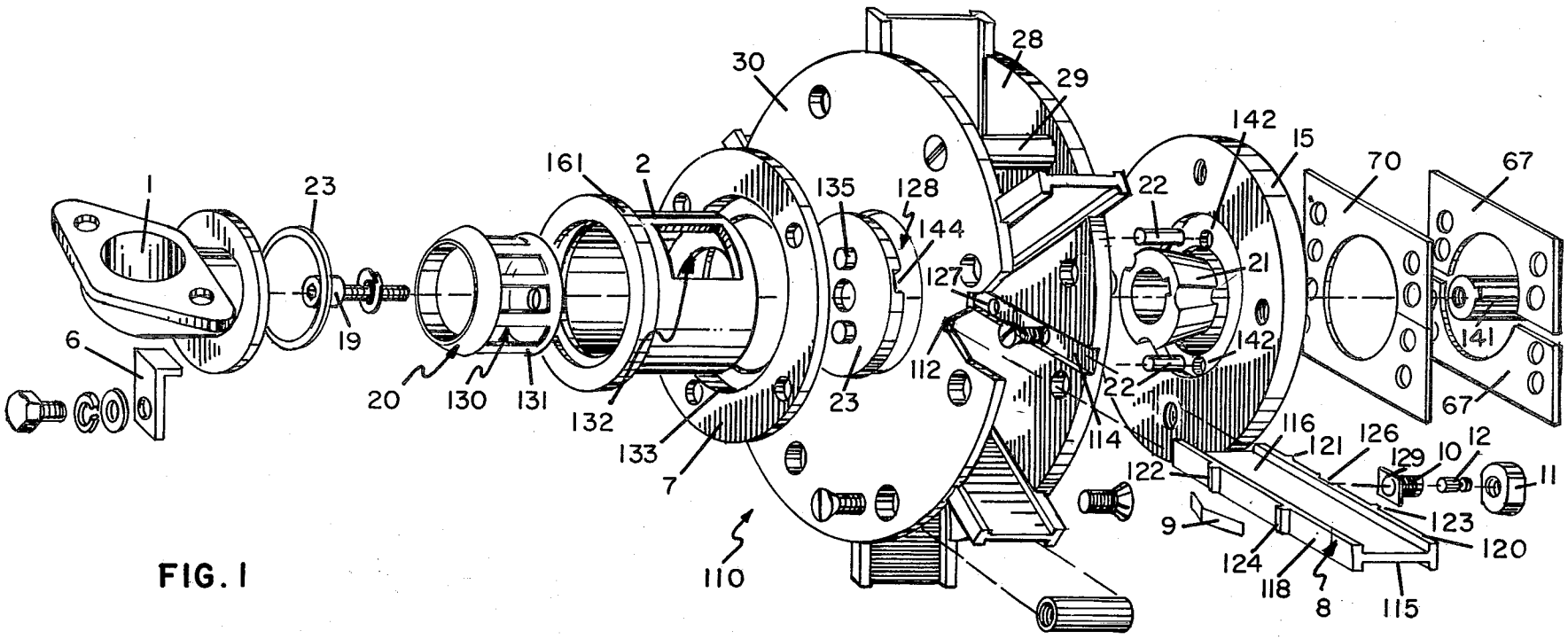
FIG. 1 is an exploded view of the wheel of this invention without the wear plates and outer casing.
Figure 2:
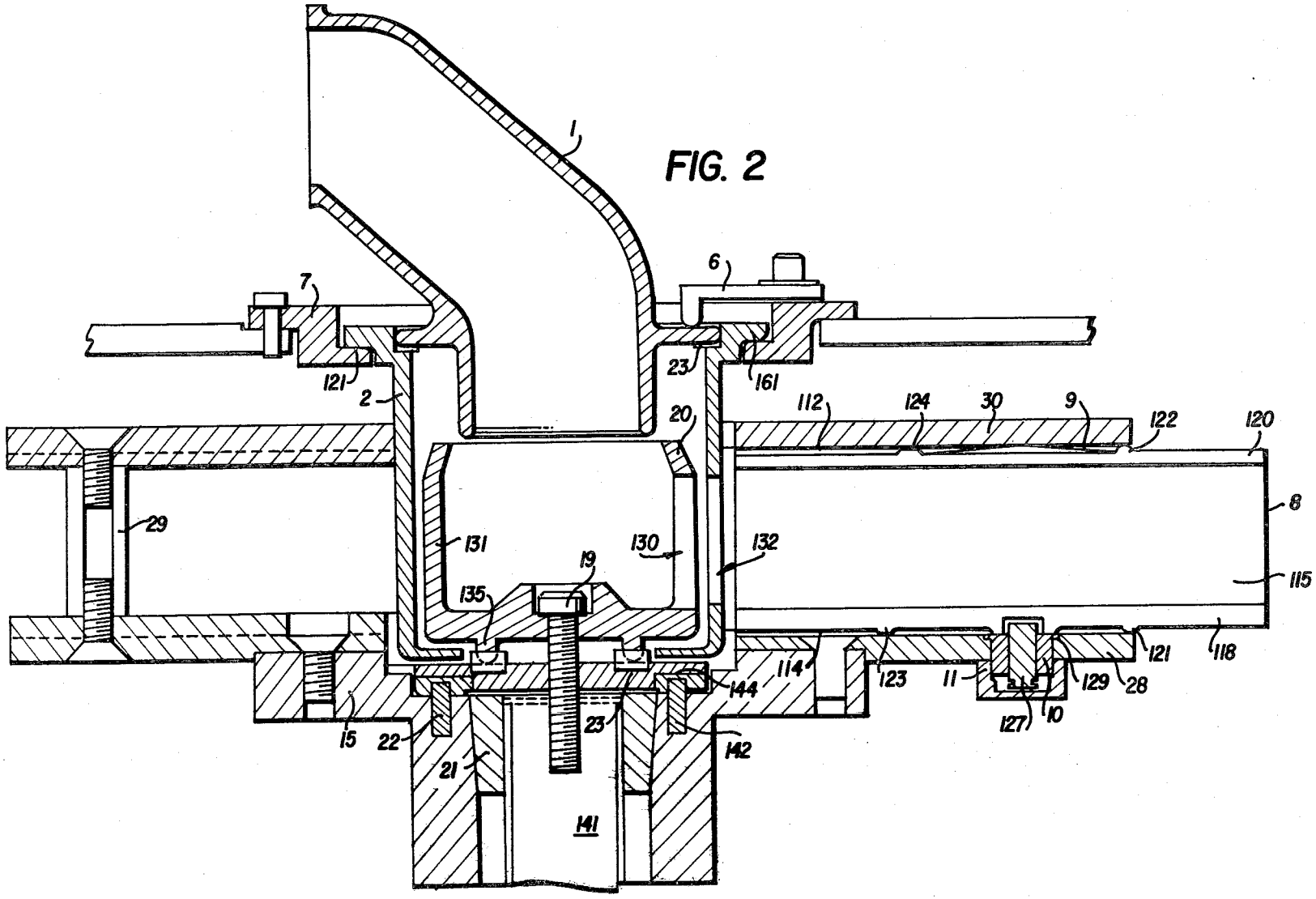
FIG. 2 is a cross-sectional view through the wheel.
Figure 5:
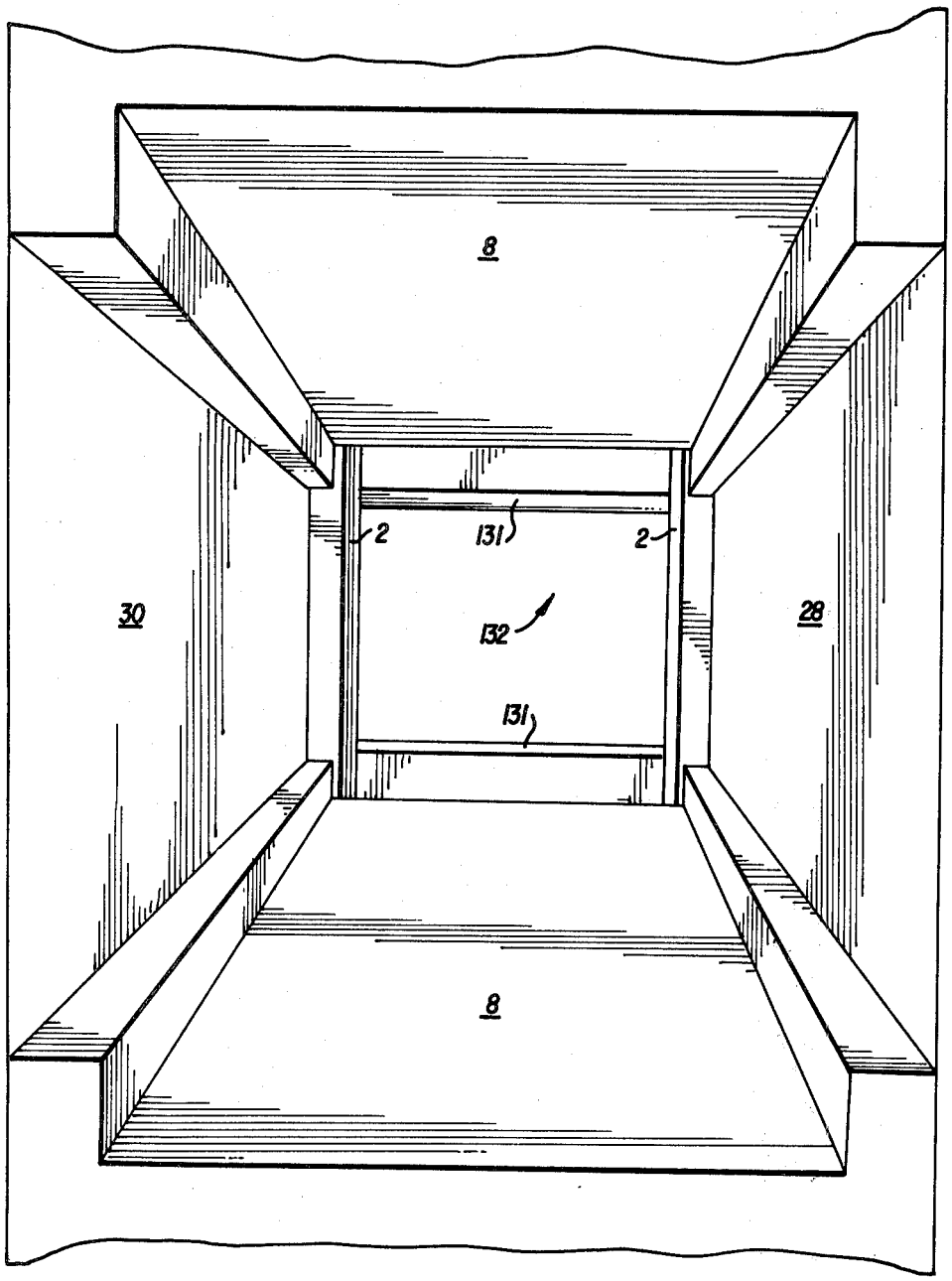
FIG. 5 illustrates a side view between two blades.

FIG. 1 shows the wheel structure in exploded view. Seen in FIG. 1 and in the cross sectional view of FIG. 2 is blast wheel 110 which is comprised of two disc-like wheel members, being outer runner head 30 and inner runner head 28, which are positioned apart from one another by a series of runner head spacers 29 a distance adapted to accommodate a series of blade members 8. Head spacers 29 are bolted in place rather than pressed into apertures as done in the prior art so that if they wear out, they can be individually replaced rather than replacing the entire wheel which replacement would be necessary in the prior art. Blade members 8 are inserted within blade member receipt slots 112 and 114 defined on the insides of runner heads 28 and 30 which slots are radially disposed at regular spacings therearound. Blade 8 has a first blade surface 116 extending to I-beam-like projections 118 and 120 on either side which are adapted to fit into the blade member receipt slots. Along the front edge of blade 8 are blade spring retainer projections 122 and 124. On the rear edge of blade 8 is defined blade locking pin receipt slot 126 and spacers 121 and 123. Spacers 121 and 123 and spring retainer projections 122 and 124 also act to leave space between the blades and the runner heads to avoid close tolerances in the spaces therebetween which might otherwise become jammed with abrasive particles. By leaving large spaces, any wedged-in abrasive particles can be removed by merely tapping the wheel and the blade can easily be freed for removal. Defined in inner running head 28 are a series of locking pin apertures 127 adapted to be aligned with the rear edge of each blade, when it has been inserted into its blade member receipt slots, at its blade locking pin receipt slots 126. Locking pin apertures 127 are located at the center of their respective blade member receipt slots. Locking pin aperture 127 is adapted to receive blade locking pin 12 which is adapted to pass therethrough and engages into the blades locking pin receipt slot 126 when blade 8 is inserted into blade member receipt slots 112 and 114. Pin bushing 10 is first inserted through pin aperture 127 from the inside of inner runner head 28, and blade locking pin 12 is inserted through pin bushing 10 which pin bushing has threading on its rear end adapted to protrude to the rear out of pin aperture 127. A flange portion 129 larger than pin aperture 127 at the front end of pin bushing 10 prevents it from passing completely therethrough. Pin cover 11 with threading along its inside is screwed onto the protruding rear end threading of pin bushing 10 and protects blade locking pin 12 from damage from abrasive particles and locks the blade locking pin 12 in position therein to hold it securely in blade lock receipt slot 126 which in turn retains blade 8. Blade spring 9 is positioned between blade spring retainer projections 120 and 124. Blade spring 9 can be a leaf spring with a bend in it that assists in holding the blade tightly against pin 12 to insure contact between blade 8 and pin 12. To reverse the blade or to replace it, pin cover 11 is unscrewed from pin bushing 10. Then blade locking pin 12 is removed and blade 8 is slid out. The blade can be replaced or flipped end over end and reversed so that its second blade surface becomes the operative surface. A series of eight of blades 8 can be disposed in regular spacing around the wheel. Central hub aperture 128 is adapted for receipt of a fixed control cage 2 having a large rectangular particle aperture 132 defined therein. This rectangular aperture allows for a uniform and non-weighted flow of abrasive particles and helps to contribute to the factors that allow the wheel to be reversible in direction without modification. Control cage 2 has flange 161 which is held within control cage flange receipt area 133 of control cage adapter 7, and feed spout clamp 6 holds feed spout 1 against control cage flange 161 in a selected stationary position. Gasket 23 prevents control cage 2 from rotating. Control cage adapter 7 is bolted to the outer casing 200 of the unit and is replaceable when worn so that one need not have to replace the outer casing when the control cage adapter area becomes worn. Within control cage 2 is inserted rotatable impellor 20 with a series of particle apertures 130 defined within the periphery thereof, each between a pair of a series of vanes 131 that correspond to the number of blades utilized. Feed spout 1 directs the abrasive particles into impellor 20. Impellor 20 is affixed by bolt 19 to motor shaft 141 and when rotating, forces the abrasive particles out through control cage aperture 132 wherein the particles pass onto each blade in turn and are projected onto the work piece. The shape of the feed spout does not form a sharp elbow but extends as an enlarged pipe at a 45° angle to prevent any restriction in abrasive particle flow. The impellor has two slots defined therein which mate with keying pin means 135 on impellor coupling 23 which in turn is driven by wheel hub 15 by its attachment thereto by drive pins 22 which extend from apertures 142 in the hub into drive slots 144 in impellor coupling 23. Wheel hub 15 is bolted to the inner runner head 28. The abrasive particles entering the feed spout as seen in FIG. 2 pass down and into impellor 20 and are forced out by and between vanes 131 through particle apertures 130 into stationary control cage 2 and can only pass out through control cage aperture 132 onto the surface of each blade in turn as it passes over control cage aperture 132 wherein the particle stream by centrifugal force due to the rotation of the blades travels outward along the blade faces and is thrown off near the tip of each blade at high velocity toward the work piece. Each impellor vane 131 is aligned on dead center with the base of each corresponding blade so that the particle aperture 130 is always aligned between the blades. The spacing between each impellor vane 131 is somewhat narrower than the inner parallel ends of adjacent blades so the abrasive particles will not strike the inner ends of the blades as seen in FIG. 5. Also in this view it can be seen that the sides of control cage apertures 132 are somewhat narrower than the positioning of runner heads 28 and 30 so abrasive particles will not strike the inside edges of the runner heads. These features allow the wheel to be rotated either clockwise or counterclockwise without modification. The 24" diameter of the wheel which is larger than the industry standard of 19.5" allows the wheel to be rotated slower while still achieving the same tip velocity as smaller wheels rotating at higher speeds. Such slower rotation is in the range of 1800 rpm rather than the more customary range of 2250 rpm of the prior art. This slower rotation along with the increased size and elongated shape of feed spout 1 allow a greater volume of abrasive particles to enter the impellor, and the enlarged impellor and control cage aperture allow greater volume of abrasive particles to be passed out onto the blade surface. For this reason in excess of 2,000 lbs of steel abrasive particles per hour per horse power have the opportunity to pass through the wheel of this invention and to be projected against the work piece. The slower rotation also produces less noise so that the device of this invention requires no special noise baffling as is required on prior art wheels. The direct drive from the motor shaft also assists in this improved capacity as no power is lost throught belt drives or friction in bearing assemblies found on other wheels. Motors between 15 and 65 brake horse power may be used without modifying the wheel of this invention except for changing taper lock bushing 21 to accommodate different size motor shafts. Hub seal member 70 composed of rubber or felt is positioned behind the hub to prevent any leakage of shot out of or entry of foreign matter into the wheel's outer casing, and seal retainer 67 holds hub seal 70 in position being bolted to the outer casing of the unit.

Figure 3:
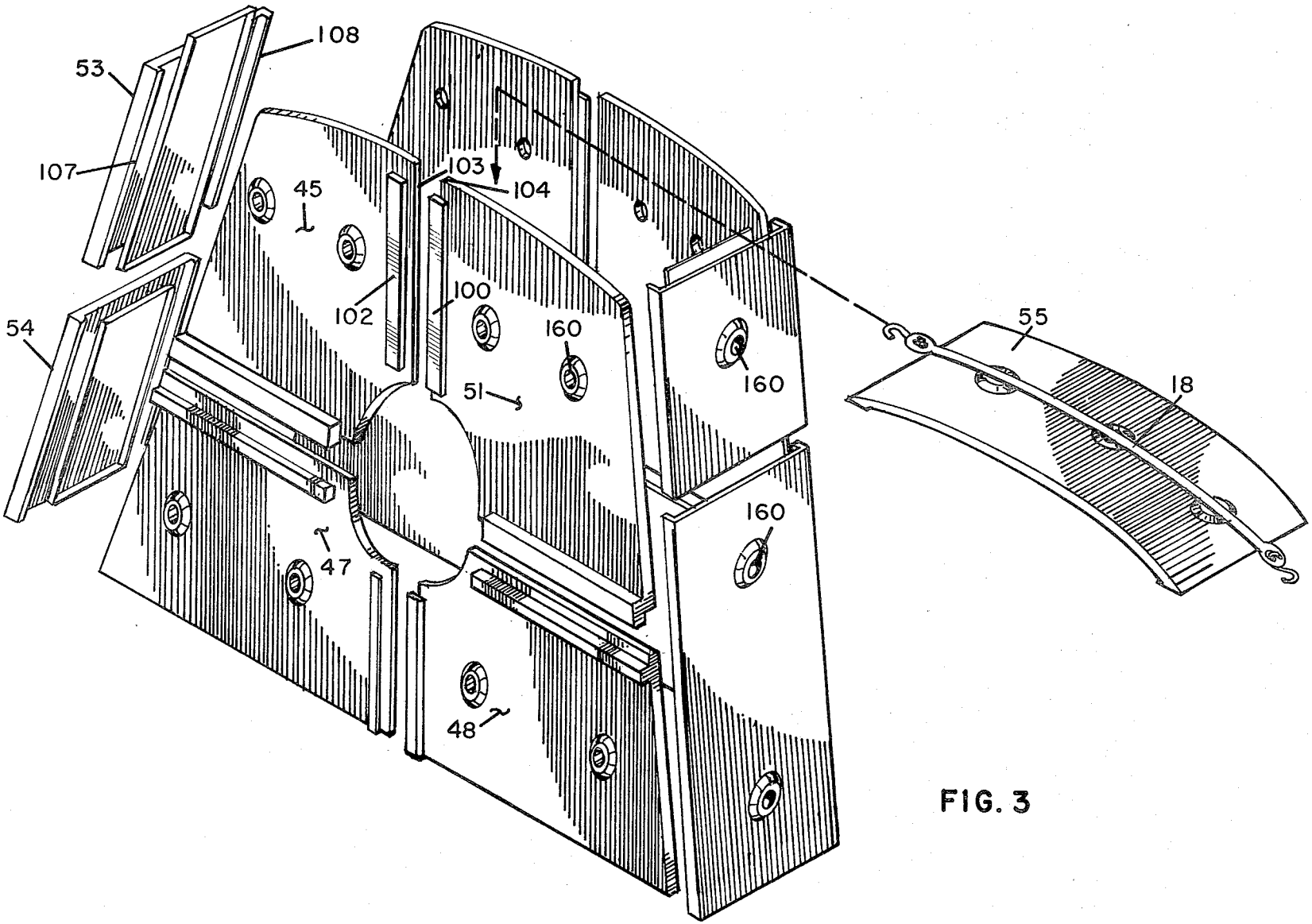
FIG. 3 illustrates the inner wear plate arrangement.
Figure 4:
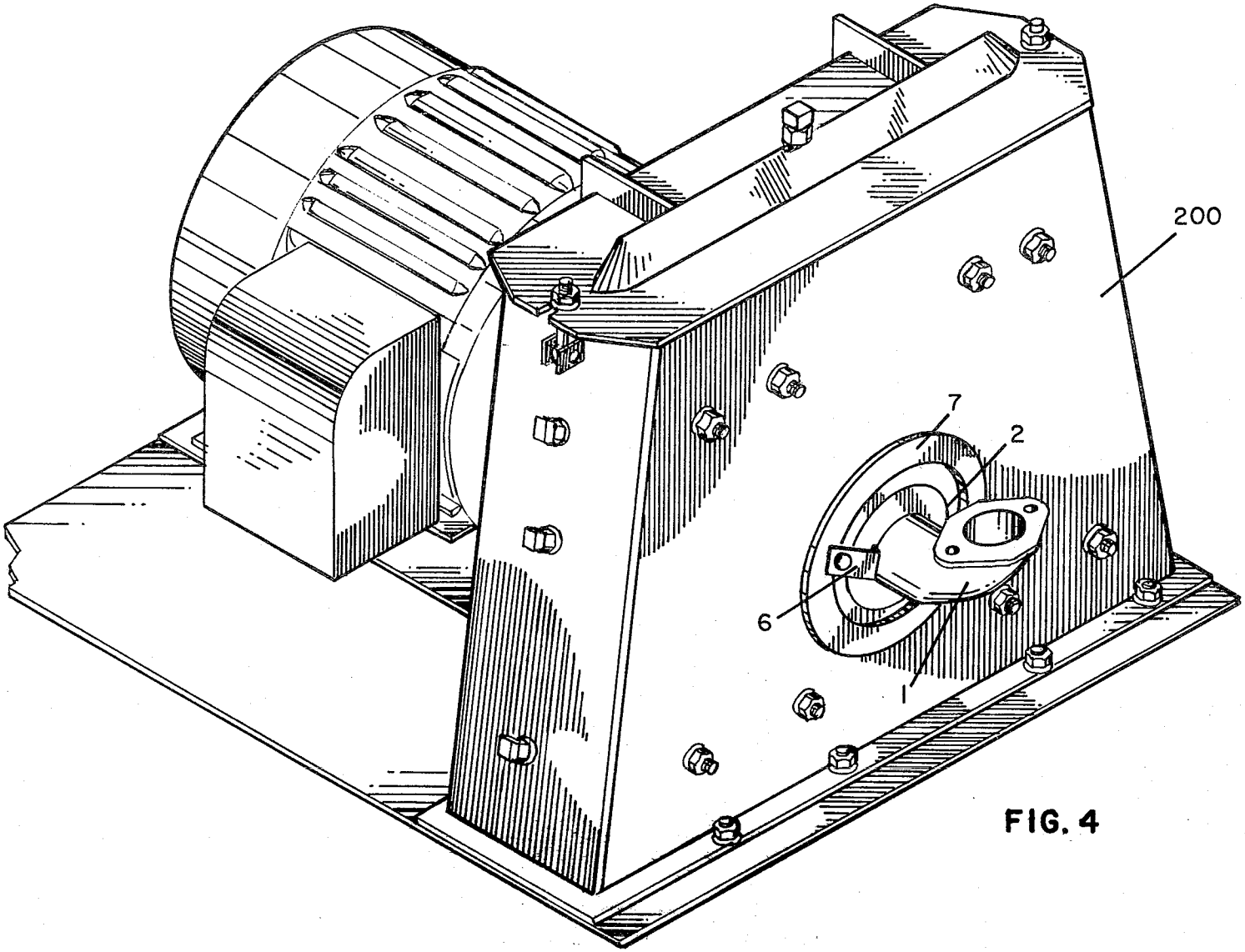
FIG. 4 illustrates the outer casing.

Seen in FIG. 3 are the improved wear liners, being topside liners 45 and 51 and lowerside liners 47 and 48. These liners are interchangeable for use either on the front or on corresponding portions of the rear of the unit so that only four different parts are needed rather than eight. The improved shiplap design utilizes back bar member 100 on the rear side of the liner adapted to overlap the rear side of the adjoining liner with back bar stop member 102 on the adjoining liner against which back bar 100 abuts so that side faces 103 and 104 of liners 45 and 51 meet securely as do the back bar stop 102 and back bar 100 to prevent escape of any shot through the juncture of the liner members. The use of such back bars eliminates the need for thinner sections of wear plates for overlapping as practiced in the prior art. The liners join in a similar fashion between lower right side liner 48 and lower left side liner 47. Top end liner 53 and lower end liner 54 are provided with an overlapping joint therebetween with edging members 107 and 108 adapted to fit around the edges of the top and lower side liners. On the outer face of top end liner 53 and lower end liner 54 are disposed bolt receipt indentations 160 against which, bolts which pass through the outer casing 200, tighten to hold the end liners in place. Top liner 55 is adapted to pass over the top of top side liners 45 and 51 and end liners 53 and 54 and is held in place by top liner strap 18. The top liner also has similar bolt receipt indentations. Improved shiplap construction and the parts interchangeability of these liners eliminate the need for stocking thirteen different liners that must be replaced due to wear so that only seven different pices need be stocked.

Although the present invention has been described with reference to particular embodiments, it will be apparent to those skilled in the art that variations and modifications can be substituted therefor without departing from the principles and spirit of the invention.

I claim:

1. An improved shot blast wheel of the type having a wheel member with a plurality of blade members disposed along radii of the wheel, said wheel driven by a motor shaft with a stationary control cage inserted within the hub of the wheel having an aperture defined therein, an impellor adapted to rotate within the control cage, and abrasive particle supply means adapted to deliver abrasive particles into the hub of the wheel to the impellor so that when the impellor rotates, the abrasive particles are forced out through said control cage aperture onto the face of each blade in turn wherein they are thrown off said blade onto a work piece, said wheel further having wear plates surrounding the areas of the wheel where abrasive particles are not to be thrown, wherein the improvements comprise:

a plurality of blades, each having a first face and a second face parallel to said first face, a first edge and a second edge, an inner end and an outer end, each blade having I-beam-like projections formed at its first and second edges, said first edge having defined thereon a pair of spaced-apart spring retainer projections, said second edge having defined therein a blade locking pin receipt slot;

said wheel, being comprised of inner and outer runner heads, having defined on facing sides of each, a plurality of radially-extending opposing blade receipt slots, each adapted to receive in sliding relationship one of said plurality of blades, inner end first, each of said blades when worn on its inner end being removable from its blade receipt slot and flipped end over end to be reinserted therein so that its outer end then is the wearing surface;

said inner runner head having a pin receipt aperture defined therein in a position along each blade receipt slot, said pin receipt aperture being in a position aligned to be opposite said blade locking pin receipt slot when said blade is inserted in position in said blade receipt slot;

a pin bushing member having an aperture defined therein, having a flange at one end thereof and threading at the other end thereof adapted to pass from between the runner heads through said pin receipt aperture so that said pin busing flange is held by said inner runner head within said blade receipt slot, and its threaded portion protrudes outside the opposite side of said inner runner head;

a blade locking pin member adapted to be positioned through said pin bushing aperture, said blade locking pin member adapted to extend into said blade locking pin receipt slot;

a pin cover member having threading along its inside adapted to screw onto the extending threaded portion of said pin bushing member in order to lock said blade locking pin in position to retain said blade in said wheel;

a spring member positioned between said spring retainer projections of said blade adapted to exert force to keep said blade in contact with said blade locking pin member;

a control cage adapter member positioned in front of the hub of said wheel having a control cage flange receipt area defined therein, said control cage having an outer flange member and a rectangular particle aperture defined therein adapted to be positioned within said control cage adapter member so that said control cage flange is received within said control cage flange receipt area of said control cage adapter member;

said abrasive particle supply means comprising a feed spout having a flange member adapted to be positioned upon a control cage receipt area defined within said control cage flange, and feed spout clamp means adapted to hold said feed spout's flange against said control cage receipt area and further held against said control cage adapter in order to retain said feed spout and control cage within the hub of said wheel;

said impellor being comprised of a plurality of vanes, between each pair of which is defined one of a plurality of shot apertures; further including:

an impellor coupling member having defined on a front face thereof impellor key driving means adapted to engage said impellor and further having defined on the rear face thereof a drive pin receipt slot;

a wheel hub member adapted to engage said impellor coupling, said wheel hub member having defined therein a drive pin receipt aperture;

a drive pin positioned in said wheel hub's drive pin receipt aperture adapted to be inserted into said impellor coupling's drive pin receipt slot;

a bolt member adapted to pass through said impellor coupling and said hub member to be affixed to said motor shaft;

means for attaching said wheel hub to said inner runner head;

said impellor being positioned so that each of its vanes is aligned with the inner end of each blade and the sides of said vanes extend beyond the faces of each blade they are positioned at the ends of and said control cage aperture is adapted so that its ends are within the inner sides of the runner heads;

a taper lock bushing adapted to be positioned within a central aperture defined within said wheel hub, said taper lock bushing having an aperture defined therein and keying means for the snug receipt of said motor shaft;

seal means positioned at the rear of said wheel hub; and said improved shot blast wheel being 24 inches in diameter and rotated in either direction at approximately 1800 rpm.

2. The improved shot blast wheel of claim 1 further including:

a wear plate assembly having an improved junction member between one of said wear plates and its adjoining wear plate;

a back bar postioned on the rear edge of said wear plate extending beyond the end thereof, said wear plate adapted to be positioned against said adjoining wear plate so that their sides meet with said back bar overlapping said adjoining wear plate; and a back bar stop member positioned on the rear of said adjoining wear plate at a point parallel and next to said overlapping back bar.

* * * * *